US007612279B1

(12) United States Patent
Schnepel et al.

(10) Patent No.: US 7,612,279 B1
(45) Date of Patent: Nov. 3, 2009

(54) METHODS AND APPARATUS FOR STRUCTURING AUDIO DATA

(75) Inventors: Soenke Schnepel, Luetjensee (DE); Stefan Wiegand, Hamburg (DE); Sven Duwenhorst, Hamburg (DE); Volker W. Duddeck, Hamburg (DE); Holger Classen, Hamburg (DE)

(73) Assignee: Adobe Systems Incorporated, San Jose, CA (US)

( * ) Notice: Subject to any disclaimer, the term of this patent is extended or adjusted under 35 U.S.C. 154(b) by 0 days.

(21) Appl. No.: 11/585,328

(22) Filed: Oct. 23, 2006

(51) Int. Cl.
*G10H 7/00* (2006.01)

(52) U.S. Cl. ..... 84/609; 84/601; 84/604; 84/615; 84/616; 84/622

(58) Field of Classification Search ..... 84/600–607, 84/609–611, 613–618, 634, 635, 637, 649–651, 84/653–656, 666, 667
See application file for complete search history.

(56) References Cited

U.S. PATENT DOCUMENTS 4,930,390 A * 6/1990 Kellogg et al. ..... 84/611
4,981,066 A * 1/1991 Kakizaki ..... 84/613
5,051,971 A * 9/1991 Yamagishi et al. ..... 369/30.09
5,510,573 A * 4/1996 Cho et al. ..... 84/610
5,525,749 A * 6/1996 Aoki ..... 84/609
5,728,962 A * 3/1998 Goede ..... 84/609
5,990,404 A * 11/1999 Miyano ..... 84/609
6,452,082 B1 * 9/2002 Suzuki et al. ..... 84/609
6,646,194 B2 * 11/2003 Kikumoto ..... 84/600
6,872,877 B2 * 3/2005 Suzuki et al. ..... 84/609
2002/0038598 A1 * 4/2002 Fujishima et al. ..... 84/609
2002/0091455 A1 * 7/2002 Williams ..... 700/94
2003/0004701 A1 * 1/2003 Ueta et al. ..... 704/1

* cited by examiner

*Primary Examiner*—Jeffrey Donels
*Assistant Examiner*—Christopher Uhlir
(74) *Attorney, Agent, or Firm*—Chapin IP Law, LLC; Barry W. Chapin, Esq.

(57) ABSTRACT

An audio formatting process identifies a musical score of audio information operable to be rendered by a rendering application. The audio formatting process enumerates aspects of the score such that the aspects are operable to define renderable features of the score. The aspects further define a duration modifiable by the rendering application to a predetermined duration that preserves the tempo of the score. Additionally, the audio formatting process stores the enumerated aspects according to a predetermined syntax operable to indicate to the rendering application the manner of accessing each of the aspects of the score.

26 Claims, 6 Drawing Sheets

METHODS AND APPARATUS FOR STRUCTURING AUDIO DATA

BACKGROUND

Conventional sound amplification and mixing systems have been employed for processing a musical score from a fixed medium to a rendered audible signal perceptible to a user or audience. The advent of digitally recorded music via CDs coupled with widely available processor systems (i.e. PCs) has made digital processing of music available to even a casual home listener or audiophile. Conventional analog recordings have been replaced by audio information from a magnetic or optical recording device, often in a small personal device such as MP3 and Ipod® devices, for example. In a managed information environment, audio information is stored and rendered as a song, or score, to a user via speaker devices operable to produce the corresponding audible sound to a user.

In a similar manner, computer based applications are able to manipulate audio information stored in audio files according to complex, robust mixing and switching techniques formerly available only to professional musicians and recording studios. Novice and recreational users of so-called "multimedia" applications are able to integrate and combine various forms of data such as video, still photographs, music, and text on a conventional PC, and can generate output in the form of audible and visual images that may be played and/or shown to an audience, or transferred to a suitable device for further activity.

SUMMARY

Digitally recorded audio has greatly enabled the ability of home or novice audiophiles to amplify and mix sound data from a musical source in a manner once only available to professionals. Conventional sound editing applications allow a user to modify perceptible aspects of sound, such as bass and treble, as well as adjust the length by performing stretching or compressing on the information relative to the time over which the conventional information is rendered. Typically, a score is created by combining or layering various musical tracks to create a musical score. A track may contain one particular instrument (such as a flute), a family of instruments (i.e., all the wind instruments), various vocalists (such as the soloist, back up singers, etc.), the melody of the musical score (i.e., the predominant 'tune' of the musical score), or a harmony track (i.e., a series of notes that complement the melody).

Conventional sound applications, however, suffer from the shortcoming that modifying the duration (i.e. time length) of an audio piece changes the tempo because the compression and expansion techniques employed alter the amount of information rendered in a given time, tending to "speed up" or "slow down" the perceived audio (e.g. music). Further, conventional applications cannot rearrange discrete portions of the musical score without perceptible inconsistencies (i.e. "crackles" or "pops") as the audio information is switched, or transitions, from one portion to another. Additionally, conventional sound applications do not allow for modification of the audio information (i.e., the musical score) based on mapping discrete audio segments arranged by audio type within a control system. Conventional sound editing applications do not provide a graphical user interface, allowing a user to modify the audio information based on audio type. A further deficiency involving conventional applications results from the lack of an audio data format that defines the raw audio files (as used in composing, rearranging and/or modifying a musical score) in a hierarchical structure such that audio data format is accessible to, and compatible with, a wide range of sound editing applications. Similarly, conventional sound applications do not provide an audio data format that describes song aspects and audio files to, i) enable rearranging discrete audio portions of a musical score while preserving the tempo; and/or ii) enable modification of audio information based on mapping discrete audio segments arranged by audio type within a control system.

Accordingly, configurations herein substantially overcome the shortcomings presented by providing an audio formatting process that defines an audio data format. The audio data format enumerates aspects of a musical score in a predetermined syntax, or scripting language, in order to provide a seamless interface between sound editing applications and the organic audio information stored as raw audio files. The audio data format defines a hierarchical object model that identifies the various elements, segments, attributes, modifiers, etc., of a musical score and the interdependencies thereof in order to provide a manner of access from a sound editing application (or rendering application) to the audio files. The hierarchical format is conducive for rendering and storing musical score variations by the temporal aspects (e.g., duration and repeatability of audio segments or parts) and by the qualitative aspects (e.g., intensity, harmony, melody, etc.) of the tracks and clips associated with the musical composition.

In accordance with embodiments disclosed herein, an audio formatting process identifies a musical score of audio information operable to be rendered by a rendering application. The audio formatting process further enumerates aspects of the score such that the aspects are operable to define renderable features of the score. In addition, the aspects further define a duration modifiable by the rendering application to a predetermined duration that preserves the tempo of the score. Furthermore, the audio formatting process enumerates at least one field associated with each aspect of the score, the fields indicative of rendering the score. With the classification of the aspects, the audio formatting process is able to store the enumerated aspects according to a predetermined syntax that is operable to indicate to the rendering application the manner of accessing each of the aspects of the score.

In an example configuration, the audio formatting process enumerates a location of an aspect in the score such that the location defines an offset time relative to a reference point in the score. Similarly, the audio formatting process enumerates a modifiable attribute associated with at least one aspect of the score. In addition, the audio formatting process enumerates a sequential assignment of an aspect relative to at least one other aspect of the score. More specifically, in accordance with example configurations, the audio formatting process enumerates a song aspect that identifies the available variations of the score. The audio formatting process also the audio formatting process enumerates a part aspect that identifies parts of the score such that each of the parts define a segment of the score operable as a rearrangeable element. With respect to the fields associated with aspects of the score, the audio formatting process identifies a name associated with the part. The audio formatting process also identifies a type associated with the part such that the type is indicative of a sequential ordering of the part. Additionally, the audio formatting process identifies a part variation identifier associated with the part. As such, the part variation identifier describes the content of a part length variation.

In another example embodiment, the audio formatting process enumerates an intensity aspect indicative of at least one intensity value for tracks of the score, wherein each track is operable to render audio content. In this manner, the audio formatting process identifies at least one track associated with the intensity value of the respective intensity aspect. Moreover, the audio formatting process enumerates a modifier aspect indicative of at least one modifier value for a plurality of tracks operable to render audio content. the audio formatting process. The audio formatting process also identifies a plurality of tracks associated with the modifier value of the respective modifier aspect. In a similar embodiment, the audio formatting process enumerates a melody attribute indicative of a melody value for the plurality of tracks. Likewise, the audio formatting process enumerates a harmony attribute indicative of a harmony value for the plurality of track. As per one example configuration, the audio formatting process identifies a preset value for each modifiable attribute such that the preset value indicates an initial value for each modifiable attribute.

In yet another embodiment, the audio formatting process enumerates a track aspect indicative of at least one track operable to render audio content. In this respect, the audio formatting process also identifies at least one clip associated with the at least one track of the score. Furthermore, the audio formatting process identifies a location associated with the at least clip, the location defining an offset time relative to a reference point in the score. According to one embodiment disclosed herein, the audio formatting process specifies a file associated with each clip, the file location indicated by a uniform resource locator (URL). The audio formatting process also provides a manner of accessing by the rendering application via a graphical user interface. In this sense, the rendering application is responsive to the manner of accessing for determining the aspects of the score, wherein the aspects of the score are indicative of file locations and file formats. In one embodiment, the audio formatting process stores the enumerated aspects according to a scripting language operable to indicate to the rendering application the manner of accessing each of the aspects of the score. More specifically, the audio formatting process may store the enumerated aspects according to an extensible markup language (XML) format.

Other embodiments disclosed herein include any type of computerized device, workstation, handheld or laptop computer, or the like configured with software and/or circuitry (e.g., a processor) to process any or all of the method operations disclosed herein. In other words, a computerized device such as a computer or a data communications device or any type of processor that is programmed or configured to operate as explained herein is considered an embodiment disclosed herein.

Other embodiments disclosed herein include software programs to perform the steps and operations summarized above and disclosed in detail below. One such embodiment comprises a computer program product that has a computer-readable medium including computer program logic encoded thereon that, when performed in a computerized device having a coupling of a memory and a processor, programs the processor to perform the operations disclosed herein. Such arrangements are typically provided as software, code and/or other data (e.g., data structures) arranged or encoded on a computer readable medium such as an optical medium (e.g., CD-ROM), floppy or hard disk or other a medium such as firmware or microcode in one or more ROM or RAM or PROM chips or as an Application Specific Integrated Circuit (ASIC). The software or firmware or other such configurations can be installed onto a computerized device to cause the computerized device to perform the techniques explained as embodiments disclosed herein.

It is to be understood that the system disclosed herein may be embodied strictly as a software program, as software and hardware, or as hardware alone. The embodiments disclosed herein, may be employed in data communications devices and other computerized devices and software systems for such devices such as those manufactured by Adobe Systems Incorporated of San Jose, Calif.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
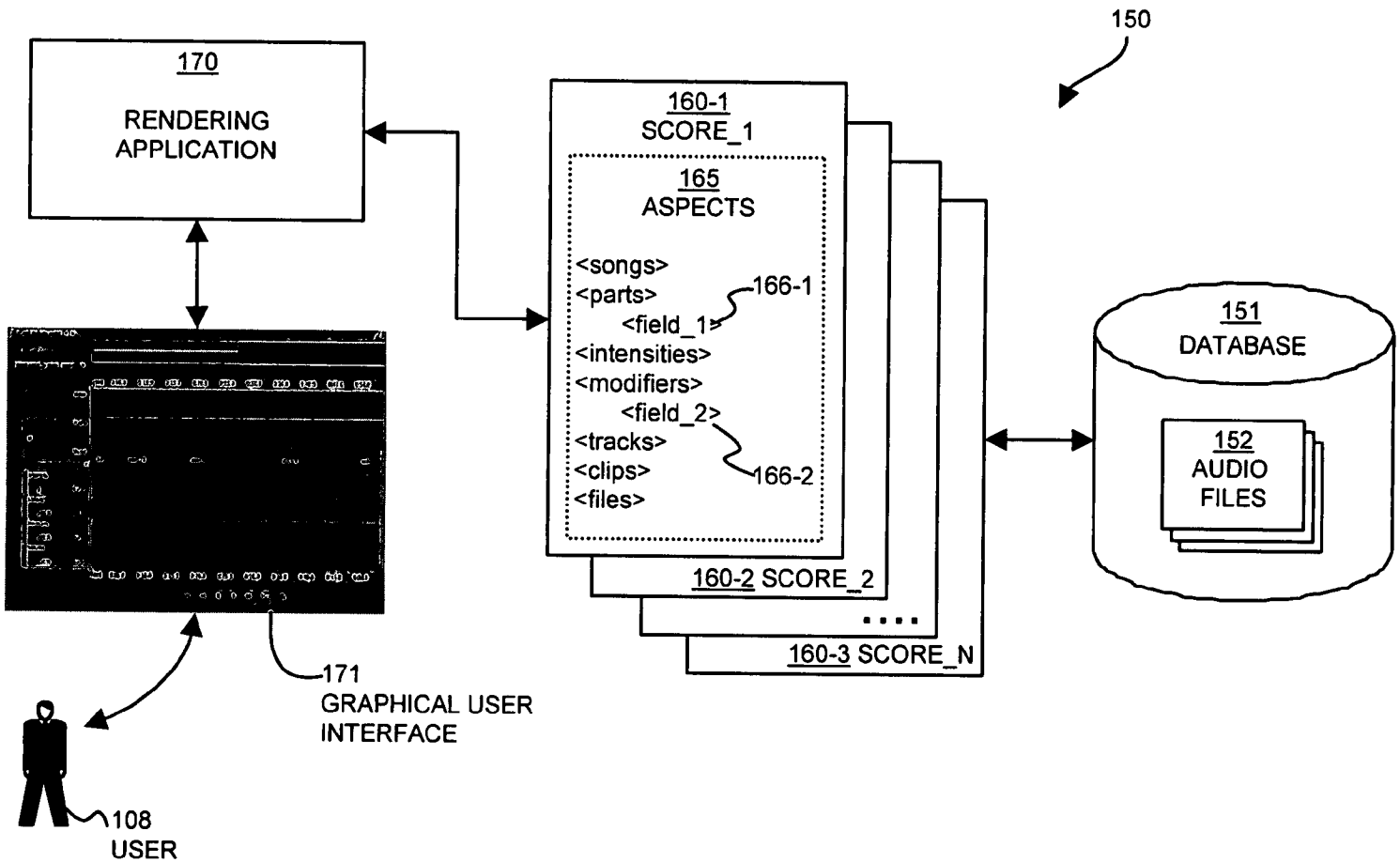
FIG. 1 is a context diagram of an exemplary audio editing environment suitable for use with the present invention.

FIG. 1 depicts an audio editing environment 150 suitable for use with example embodiments disclosed herein. The audio editing environment 150 includes a database 151 that contains various audio files with audio content operable for creating musical compositions and variations of the musical compositions. The audio files 152 are organized and structured according to a predetermined syntax (e.g., as a Document Object Model "DOM" described in a scripting language such as XML) and are identifiable as separate scores: score_1 160-1, score_2 160-2 . . . score_N 160-3 (herein collectively referred to as scores 160). As such, each score 160 described herein represents a separate DOM instantiation for a specific score (e.g., song) and are modifiable by a rendering application 170. More specifically, each score 160 enumerates aspects 165 (e.g., logical components of the musical score such as parts, part variations, tracks, intensities, etc.) of a musical composition that structure the audio files 152, and interdependencies thereof, in a manner suitable for constructing and rendering musical score variations having different durations. The aspects 165 further define fields 166 (e.g., field_1 166-1 and field_2 166-2 depicted in FIG. 1) that define various properties and/or values specific to a respective aspect 165. In operation, the predetermined syntax of the scores 160 provides a manner of access from the rendering application 170 to the aspects 165 of the scores (e.g., via an XML configuration). It should be noted that the aspects 165 and fields 166 shown in FIG. 1 is an example embodiment, and that other aspects 165 and fields 166, or fewer aspects 165 and fields 166, may also be incorporated as part of the score 160 while remaining within the scope of the invention.

Still referring to FIG. 1, the rendering application 170 displays audio information to a user 108 via a graphical user interface 171 in accordance with an example embodiment. The graphical user interface 170 displays the audio information (e.g., a musical score) in a modifiable format such that the user 108 can manipulate the audio information to create a desirable result (e.g., a song variation having a shorter or longer duration than the original song composition while preserving tempo). In an exemplary embodiment, the database 151, rendering application 170 and graphical user interface 171 are situated in a single device (e.g., personal computer, workstation, laptop, etc.); however, such an example configuration should not be construed to limit the scope of the methods and techniques described herein to a single device. Instead, the elements of the audio editing environment 150 may also be situated in separate physical and/or logical configurations relative to one another (e.g., the database may be situated in a remote server accessible from the Internet).

An example scripting language format (e.g., XML code) operable for use with the above configuration is shown in Table I:

TABLE I

```
<!-- example script enumerating aspects 165 and fields 166 of score
160-1>
<score>...</score>
<song>...</song>
<parts>
    <!-- fields:
        <id>      unique id of the part
        <name>    the name of the part
        <type>    {intro, main, outro}
    -->
    <part>
    <part id="1" name="Intro" type="intro">
        <!-- fields:
            <id>      unique i.d of the part variation
            <name>    the name of the part variation
        -->
        <partvariation>
        <partvariation id="1" name="Intro_8Bars">
            <clip>
            <clipref id="1" refid="1" type="start">
            </clip>
            <!-- next clip starts here>
        </partvariation>
        <!-- next partvariation starts here>
    </part>
    <!-- next part starts here>
</parts>
<intensities>...</intensities>
<modifiers>...</modifiers>
<tracks>...</tracks>
<clips>...</clips>
<files>...</files>
<presets>...</presets>
```

Referring to Table I, the example script depicts enumerated aspects 165 for a particular score (e.g., score 160-1) in a collapsible form such that the fields 166 associated with each aspect are not shown. The aspects 165 and fields 166 in Table I are designated as tags enclosed by '<' and '>' symbols. To exemplify a typically script format, the "parts" aspect is expanded such that the fields 166 and subordinate aspects 165 associated with the "parts" aspect are shown in Table I. For example, the parts aspect enumerates an "id", "name" and "type" field for defining a "part" aspect of the score 160. In the example shown in Table I, the "part" aspect is subordinate to the "parts" aspect such that a single part of the score 160 is a subset of the parts as a whole. Similarly, the "partvariation" aspect is a subset of the "part" aspect and, consequently, the "clip" aspect is a subset of the "partvariation" aspect, and so on. It should be noted that script is not limited to the aspects 165 and fields 166 shown in FIG. 1. Thus, a scripting language defining the audio files 152 may include other aspects 165 and fields 166, or fewer aspects 165 and fields 166, and may have differing subordinate relationships (e.g., a different hierarchical structure) with respect to one another in order to provide a manner of access to the rendering application 170 such that a user 108 can modify a musical composition in accordance with the methods described herein.

Figure 2:
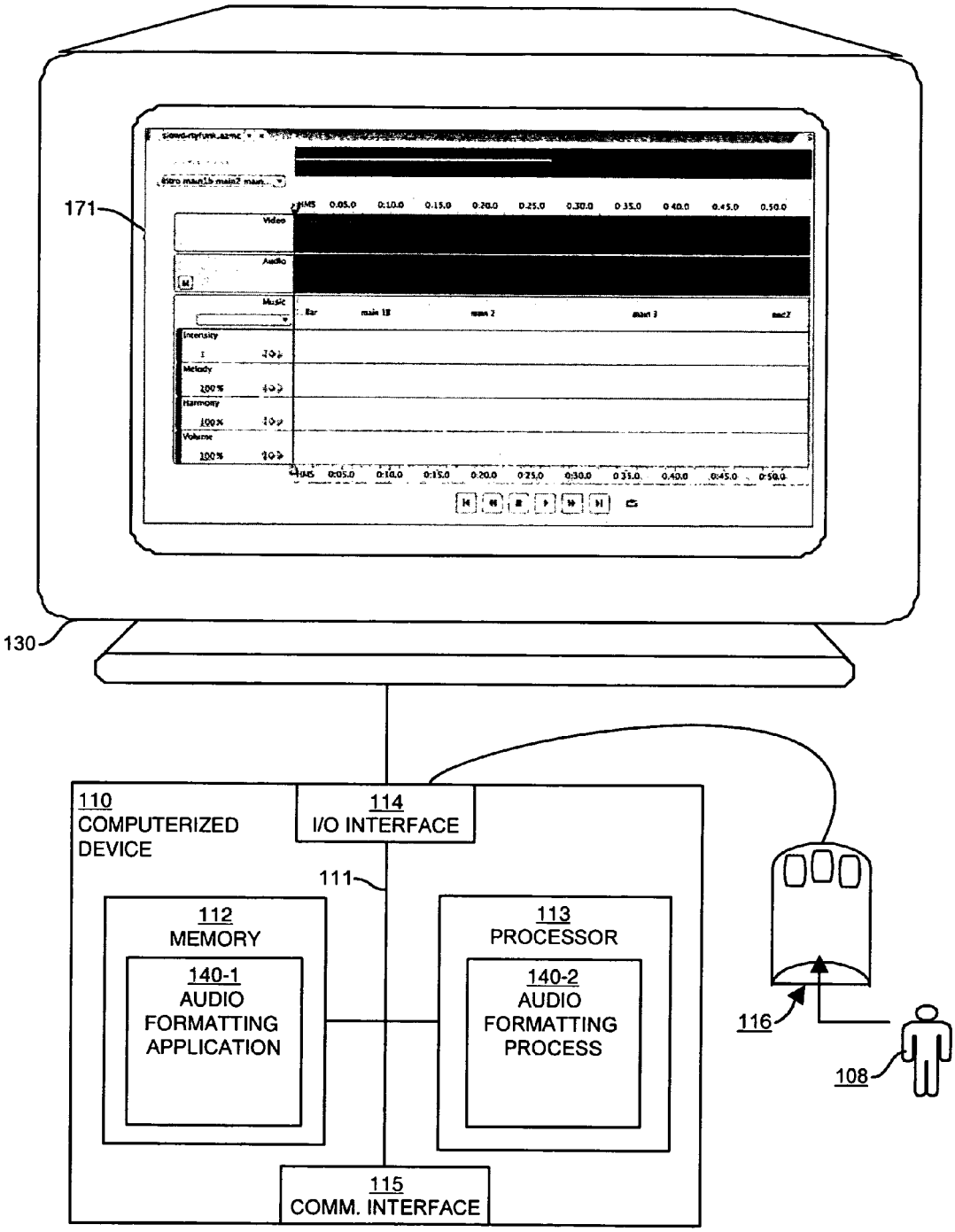
FIG. 2 is a block diagram of a computerized system configured with an application including an audio formatting process in accordance with one example configuration.

FIG. 2 is a block diagram illustrating example architecture of a computer system 110 that executes, runs, interprets, operates or otherwise performs an audio formatting application 140-1 and process 140-2. The computer system 110 may be any type of computerized device such as a personal computer, workstation, portable computing device, console, laptop, network terminal or the like. As shown in this example, the computer system 110 includes an interconnection mechanism 111 such as a data bus or other circuitry that couples a memory system 112, a processor 113, an input/output interface 114, and a communications interface 115. An input device 116 (e.g., one or more user/developer controlled devices such as a pointing device, keyboard, mouse, etc.) couples to processor 113 through I/O interface 114, and enables a user 108 to provide input commands and generally control the graphical user interface 171 that the audio formatting application 140-1 and process 140-2 provides on the display 130. The communications interface 115 enables the computer system 110 to communicate with other devices (i.e., other computers) on a network (not shown). This can allow access to the audio information modifying application by remote computer systems and in some embodiments, the work area 150 from a remote source via the communications interface 115.

The memory system 112 is any type of computer readable medium and in this example is encoded with an audio formatting application 140-1. The audio formatting application 140-1 may be embodied as software code such as data and/or logic instructions (e.g., code stored in the memory or on another computer readable medium such as a removable disk) that supports processing functionality according to different embodiments described herein. During operation of the computer system 110, the processor 113 accesses the memory system 112 via the interconnect 111 in order to launch, run, execute, interpret or otherwise perform the logic instructions of the audio formatting application 140-1. Execution of audio formatting application 140-1 in this manner produces processing functionality in a audio formatting process 140-2. In other words, the audio formatting process 140-2 represents one or more portions of runtime instances of the audio formatting application 140-1 (or the entire application 140-1) performing or executing within or upon the processor 113 in the computerized device 110 at runtime.

Flow charts of the presently disclosed methods are depicted in FIGS. 3 through 6. The rectangular elements are herein denoted "steps" and represent computer software instructions or groups of instructions. Alternatively, the steps are performed by functionally equivalent circuits such as a digital signal processor circuit or an application specific integrated circuit (ASIC). The flow diagrams do not depict the syntax of any particular programming language. Rather, the flow diagrams illustrate the functional information one of ordinary skill in the art requires to fabricate circuits or to generate computer software to perform the processing required in accordance with the present invention. It should be noted that many routine program elements, such as initialization of loops and variables and the use of temporary variables are not shown. It will be appreciated by those of ordinary skill in the art that unless otherwise indicated herein, the particular sequence of steps described is illustrative only and can be varied without departing from the spirit of the invention. Thus, unless otherwise stated the steps described below are unordered meaning that, when possible, the steps can be performed in any convenient or desirable order.

Figure 3:
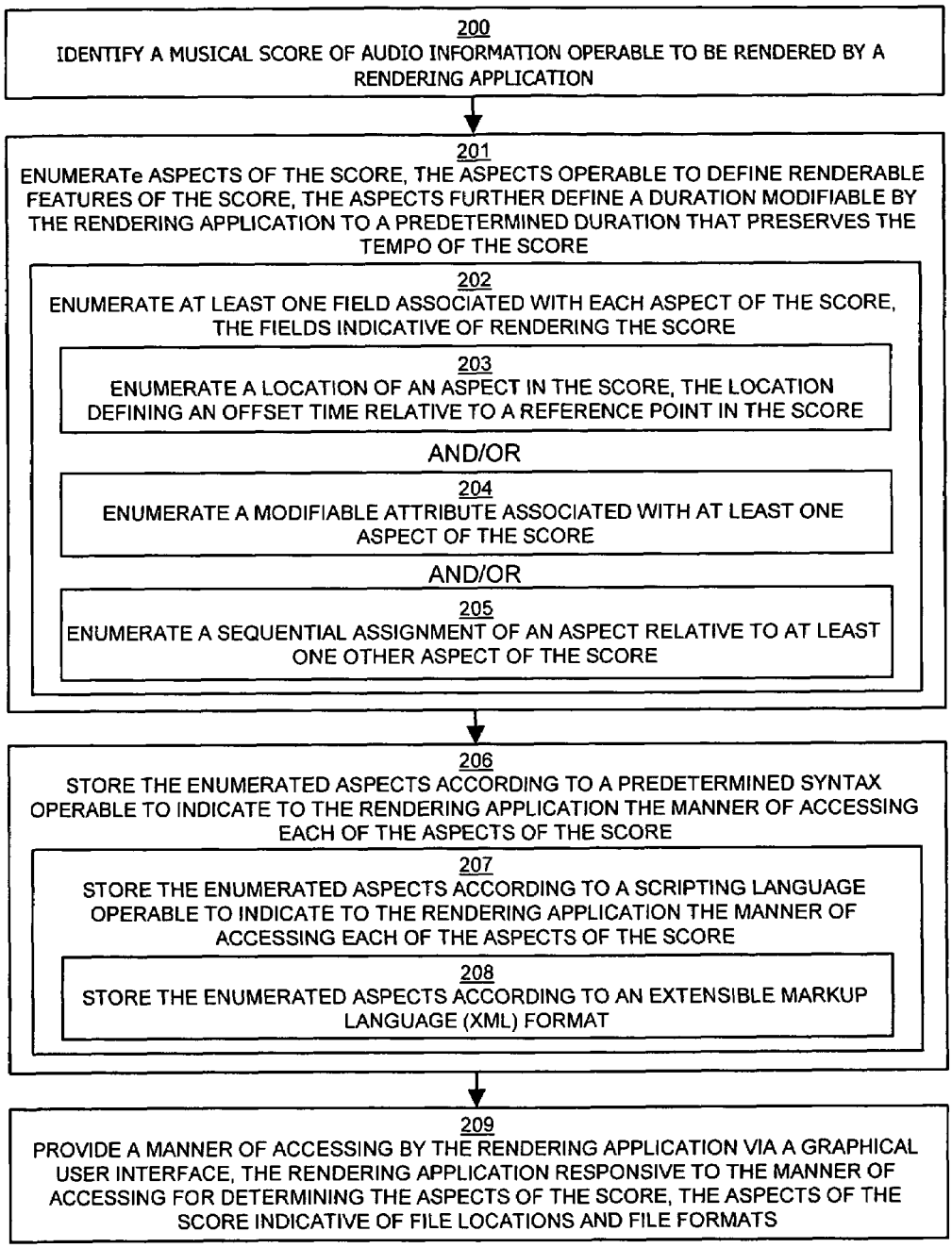
FIG. 3 is a flow chart of processing steps that shows high-level processing operations performed by the audio formatting process when it identifies a musical score of audio information operable to be rendered by a rendering application in accordance with one example embodiment.

FIG. 3 is a flow chart of processing steps that shows high-level processing operations performed by the audio formatting process 140-2 when it identifies a musical score 160-1 of audio information operable to be rendered by a rendering application 170 in accordance with an example embodiment.

In step 200, the audio formatting process 140-2 identifies a musical score 160-1 of audio information operable to be rendered by a rendering application 170. As shown in the example embodiment of FIG. 1, the musical score 160-1 of audio information comprises, in its organic form, audio files 152 located in database 151. The audio files 152 may be any typical audio-definable file type known in the art such as, but not limited to, Waveform Audio Format (WAV) files ".wav", Moving Pictures Experts Group (MPEG-1) Audio Layer 3 files ".mp3", and the like. In one embodiment, the audio files 152 represent track and/or clip elements of the musical score necessary for constructing a musical score with varying durations. The rendering application may be any audio editing software known in the art. For example, in one example embodiment, the audio editing application may be the SOUNDBOOTH application, marketed commercially by Adobe Systems Incorporated, of San Jose, Calif.

In step 201, the audio formatting process 140-2 enumerates aspects 165 of the score 160-1. The aspects 165 are operable to define renderable features of the score 160-1 and further define a duration modifiable by the rendering application 170 to a predetermined duration that preserves the tempo of the score 160-1. In conventional audio editing software, compression and expansion techniques employed alter the amount of audio information rendered in a given time (e.g., beats per minute), which tends to "speed up" or "slow down" the perceived audio (e.g. music). Conversely, the audio formatting process 140-2 disclosed herein provides aspects 165 operable to define renderable features of the score 160-1 such that the tempo remains constant (vis-à-vis the original music composition) for the entirety of the modified resulting musical composition. The methods for varying the duration of musical compositions while preserving the tempo are augmented by techniques discussed in copending patent application Ser. No. 11/585,289, entitled "METHODS AND APPARATUS FOR REPRESENTING AUDIO DATA", filed concurrently, incorporated herein by reference.

In step 202, the audio formatting process 140-2 enumerates at least one field 166 associated with each aspect 165 of the score 160-1, wherein the fields 166 are indicative of rendering the score 160-1. The fields 166 represent properties and/or values particular to an aspect 165 of the score 160-1 and provide context for rendering the musical content defined by the aspects 165. Referring to the example script shown in Table I, the "parts" aspect defines an "id" field, a "name" field and a "type" field. As a result, each of the subordinate "part" aspects enumerated in the script have a corresponding value for each of "id", "name" and "type" fields.

In step 203, the audio formatting process 140-2 enumerates a location of an aspect 165 in the score 160-1 such that the location defines an offset time relative to a reference point in the score 160-1. Stated differently, the location represents an anchor or cue point for an aspect 165 (e.g., a clip) to be inserted into the musical composition. For example, in one embodiment the location is an offset in samples of a clip from a reference point in the song (e.g., the beginning of a song, the end of a separate clip, etc.)

In step 204, the audio formatting process 140-2 enumerates a modifiable attribute associated with at least one aspect 165 of the score 160-1. The modifiable attributes (e.g., intensity, melody, harmony, etc.) represent a qualitative value associate with the audio information and does not typically impact the duration of a musical composition (e.g., song). The methods for modifying the qualitative attributes of musical compositions are augmented by techniques discussed in copending patent application Ser. No. 11/585,352, entitled "METHODS AND APPARATUS FOR MODIFYING AUDIO INFORMATION", filed concurrently, incorporated herein by reference. Furthermore, as in one example configuration, the audio formatting process 140-2 identifies a preset value for each modifiable attribute, wherein the preset value is indicative of an initial value for each modifiable attribute. For example, the preset value for intensity may be 1.0 while the preset value for harmony may be 0.5 for a given score 160. As such, the values for the modifiable attributes are typically normalized for a predetermined range to provide a seamless interface and more simple interaction for a user 108 of audio editing software.

In step 205, the audio formatting process 140-2 enumerates a sequential assignment of an aspect 165 relative to at least one other aspect 165 of the score 160-1. More specifically, the sequential assignment describes the ordering of the parts as well as the ordering of the clips within those parts. Referring to the example script in Table I, the sequential assignment is represented by the value of the "id" field for each part and clip. For example, the part aspect in Table I defines a "part id=1" and, thus, denotes that this particular part is the first in the sequence of one or more parts associated with the "parts" aspect in the hierarchy. Likewise, the clip aspect defines a "clipref id=1" denoting that this is the first clip in a sequence of one or more clips associated with the first part aspect.

In step 206, the audio formatting process 140-2 stores the enumerated aspects 165 according to a predetermined syntax (e.g., score 160-1 as shown in Table I and FIG. 1) operable to indicate to the rendering application 170 the manner of accessing each of the aspects 165 of the score 160-1. In one example configuration, the predetermined syntax is a DOM representation of the audio information (e.g., the audio files) in the form of a scripting language (e.g., XML). The DOM representation of the audio information provides a format and structure conducive for seamless and user-friendly modification of audio information (e.g., changing the duration of a song) by those users less adept at composing music. Typically, as in one embodiment, the DOM representation of the audio information that defines a musical score is stored as a separate data file along with the audio files 152 in database 151.

In step 207, the audio formatting process 140-2 stores the enumerated aspects 165 according to a scripting language operable to indicate to the rendering application 170 the manner of accessing each of the aspects 165 of the score 160-1. More specifically, in step 208, the audio formatting process 140-2 stores the enumerated aspects 165 according to an extensible markup language (XML) format. The enumerated aspects 165 may also be stored according to other scripting or markup language generally known in the art that are suitable for describing data.

In step 209, the audio formatting process 140-2 provides a manner of accessing by the rendering application 170 via a graphical user interface 171. The rendering application 170 is responsive to the manner of accessing for determining the aspects 165 of the score 160-1, wherein the aspects 165 of the score 160-1 are indicative of file locations and file formats. For example, while the graphical user interface 171 provides an interface for the user 108 to interact with the rendering application 170, the predetermined syntax (e.g., score 160-1 as described in an XML format) provides an interface, or manner of access, for the rendering application 170 to interact with the raw audio files 152 in database 151. In essence, the hierarchical structure of the DOM framework enables the user 108 (via rendering application 170 and graphical user interface 171) to modify the temporal and qualitative attributes of a musical composition from a large group of raw audio files.

Figure 4:
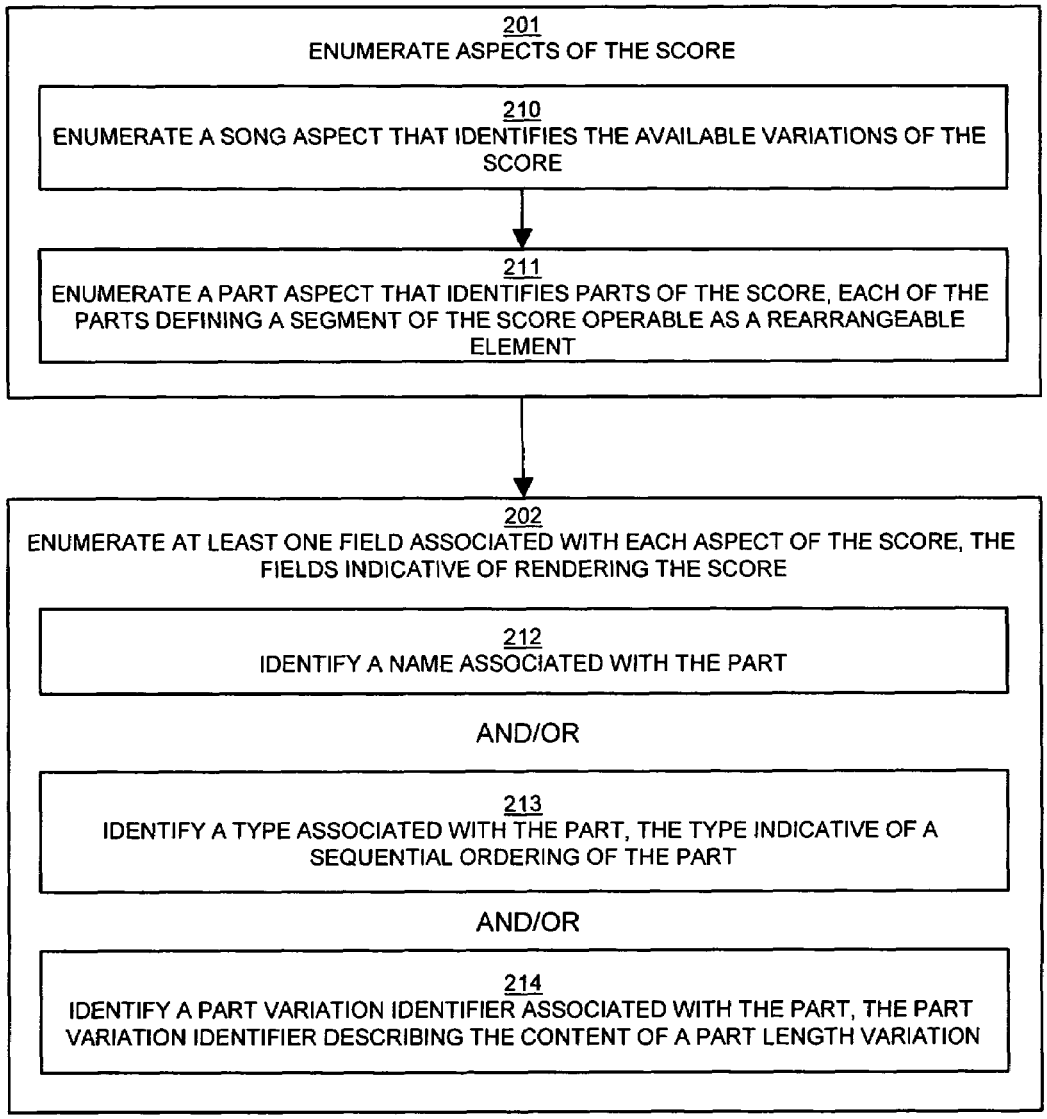
FIG. 4 is a flow chart of processing steps that shows high-level processing operations performed by the audio formatting process when it enumerates aspects of the score in accordance with one example embodiment.

FIG. 4 is a flow chart of processing steps that shows high-level processing operations performed by the audio formatting process 140-2 when it enumerates aspects 165 of the score 160-1 in accordance with an example embodiment.

In step 210, the audio formatting process 140-2 enumerates a song aspect that identifies the available variations of the score 160-1. For example, in one embodiment the song aspect includes fields 166 defining the part id's, or part aspects, of the song variation and a default part variation to be used in rendering the audio information. Additionally, the song aspect fields define a minimum and/or maximum number of how many times the respective part should be played in the particular song variation.

In step 211, the audio formatting process 140-2 enumerates a part aspect that identifies parts of the score 160-1 such that each of the parts defines a segment of the score operable as a rearrangeable element. Table I depicts an example script configuration that defines a part aspect that may be arranged in any desirable order with respect to one or more part aspects (e.g., by designating a corresponding value for the sequential assignment). In another embodiment, the part aspect includes a subordinate part variation aspect that defines the part variations (e.g., parts differing in length or beats).

In step 212, the audio formatting process 140-2 identifies a name associated with the part. As shown in the example script configuration of Table I, the enumerated part aspect is designated with the name "Intro". Typically, the name is indicative of the respective ordering of the part in the sequence of the musical composition (e.g., "Intro" denotes that the part is located near the beginning of the song).

In step 213, the audio formatting process 140-2 identifies a type associated with the part, wherein the type indicative of a sequential ordering of the part. Still referring to Table I, the enumerated part aspect is designated with the type "intro". Similar to the name attribute, the type also is indicative of the respective ordering of the part in the sequence of the musical composition.

In step 214, the audio formatting process 140-2 identifies a part variation identifier associated with the part such that the part variation identifier describes the content of a part length variation. Generally, a part may have multiple variations containing the same content but with varying durations as dictated by the number of clips associated with the respective part variation. Accordingly, the part variation shown in Table I includes at least one subordinate clip aspect. In one example embodiment, the clip aspect includes fields 166 defining the position in samples of the clip, the number of bars of the clip, the number of beats of the clip, and/or the metric unit of the clip (e.g., quarter, eighth, etc.)

Figure 5:
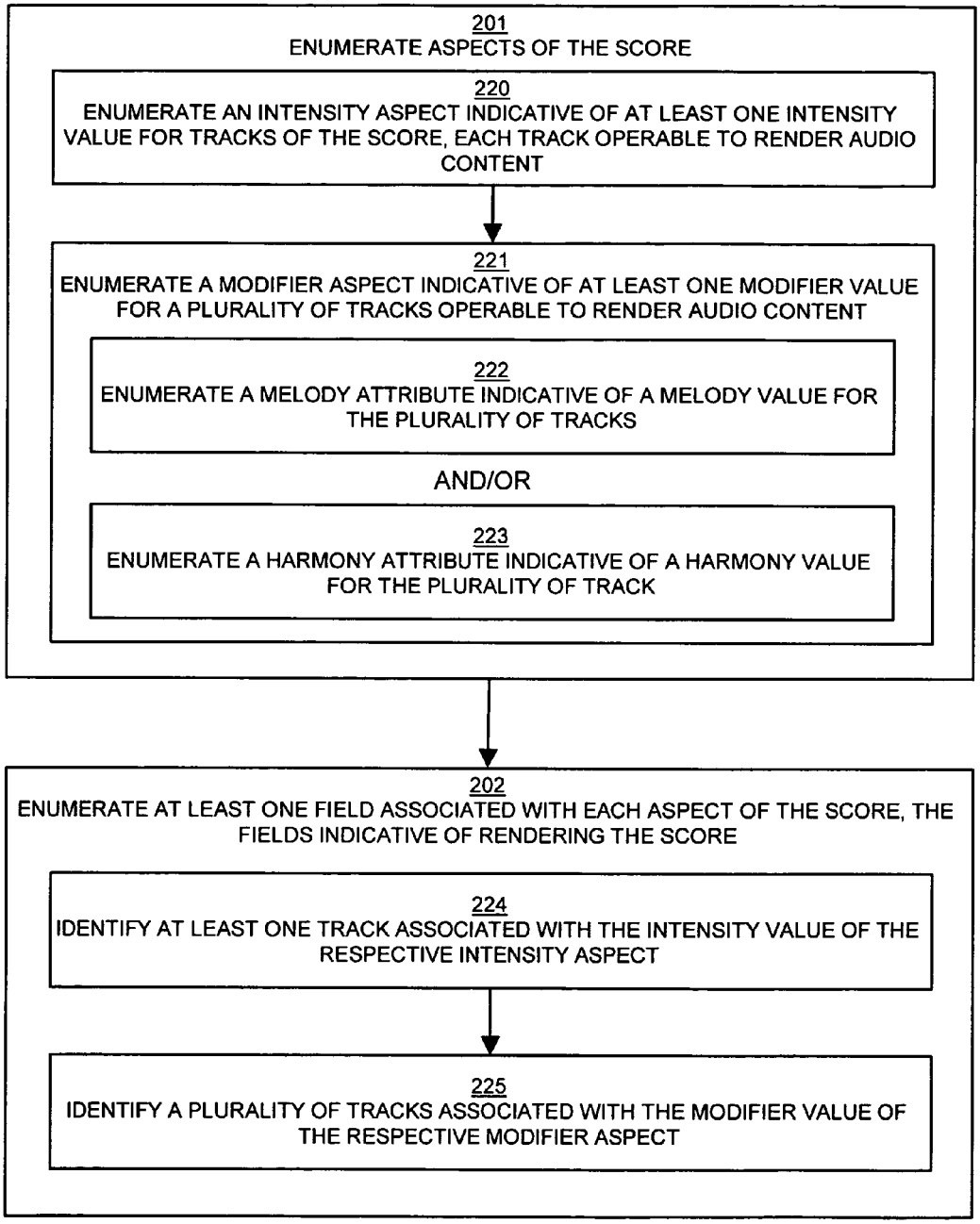
FIG. 5 is a flow chart of processing steps that shows high-level processing operations performed by the audio formatting process when it enumerates aspects of the score in accordance with one example embodiment.

FIG. 5 is a flow chart of processing steps that shows high-level processing operations performed by the audio formatting process 140-2 when it enumerates aspects 165 of the score 160-1 in accordance with an example embodiment.

In step 220, the audio formatting process 140-2 enumerates an intensity aspect indicative of at least one intensity value for tracks of the score 160-2, wherein each track is operable to render audio content. An intensity aspect defines all tracks assigned to the specific intensity value of the respective intensity aspect. According to one example configuration, the intensity aspect includes fields 166 defining the intensity group identity (e.g., "group id=1" represents a low intensity level) and the name of the intensity group (e.g., "Low"). In addition, the intensity aspect includes subordinate track aspects representing the tracks assigned to the particular intensity group. As such, the track aspects define the identity of the track, reference identity of the track and the individual gain, or volume, of the track.

In step 221, the audio formatting process 140-2 enumerates a modifier aspect indicative of at least one modifier value for a plurality of tracks operable to render audio content. A modifier aspect defines all tracks assigned to the specific modifier value of the respective modifier aspect. As per one example configuration, the modifier aspect includes fields 166 defining the identity of the modifier group (e.g., an integer value), the name of the modifier group (e.g., harmony, melody, etc.), and the default gain, or volume, of the respective modifier aspect.

In step 222, the audio formatting process 140-2 enumerates a melody attribute indicative of a melody value for the plurality of tracks. Similarly, in step 223, the audio formatting process 140-2 enumerates a harmony attribute indicative of a harmony value for the plurality of track.

In step 224, the audio formatting process 140-2 identifies at least one track associated with the intensity value of the respective intensity aspect. For example, as in one embodiment, the intensity aspect includes at least one subordinate track aspect associated with the respective intensity value of the intensity aspect. In this manner, the track aspect includes fields defining the track identity associated with the intensity group.

In step 225, the audio formatting process 140-2 identifies a plurality of tracks associated with the modifier value of the respective modifier aspect. As in one example embodiment, the modifier aspect includes at least one subordinate track aspect associated with the respective modifier value of the modifier aspect (e.g., harmony). In this manner, the track aspect includes fields defining the track identity associated with the modifier group.

Figure 6:
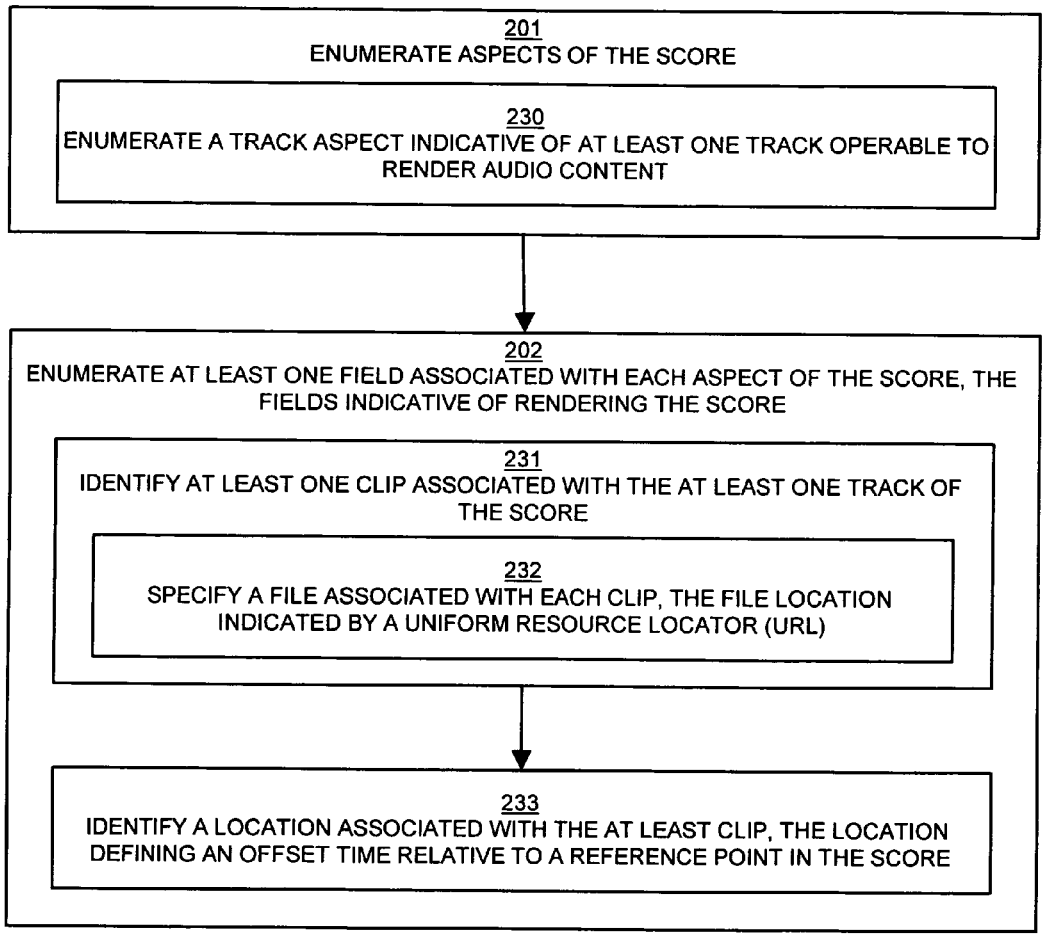
FIG. 6 is a flow chart of processing steps that shows high-level processing operations performed by the audio formatting process when it enumerates aspects of the score in accordance with one example embodiment.

FIG. 6 is a flow chart of processing steps that shows high-level processing operations performed by the audio formatting process 140-2 when it enumerates aspects 165 of the score 160-1 in accordance with an example embodiment.

In step 230, the audio formatting process 140-2 enumerates a track aspect indicative of at least one track operable to render audio content. Typically, as in one example embodiment, the track aspect includes fields defining the track identity (e.g., an integer value) and the name of the track (e.g., Drums). In an alternate embodiment, the track aspect includes at least one subordinate clip aspect as described below.

In step 231, the audio formatting process 140-2 identifies at least one clip associated with the at least one track of the score. According to an example embodiment, the clip aspect includes fields defining the clip identity (e.g., an integer value), the reference file identity (e.g., a file locator such as a Uniform Resource Locator "URL"), the name of the clip (e.g., Drums_Special__2 Bars), the offset in samples of the clip and the number of samples of the clip.

In step 232, the audio formatting process 140-2 identifies a location associated with the at least clip, wherein the location defining an offset time relative to a reference point in the score 160-1. For example, in one embodiment the clip aspect provides a field defining an offset value that specifies a predetermined offset time relative to a reference point in the score 160-1 (e.g., the beginning of the song).

In step 233, the audio formatting process 140-2 specifies a file (e.g., audio file 152) associated with each clip. According to an example configuration, the file location is indicated by a uniform resource locator (URL).

In one embodiment, the score 160-1 includes a score aspect as shown in Table I. The score aspect may include, but is not limited to, fields 166 that define specific data related to the score such as the name of the song/score, the composer, the creation date, copyright information, genre (e.g., "Rock"), style (e.g., "Modern", "sad"), the sample rate of the song, and the like. In yet another example embodiment, the score 160-1 includes a beat aspect wherein the beat aspect may include, but is not limited to, fields that define time measurements such as the beat nominator, the beat denominator, the beats per minute, and/or similar time measures related to a musical composition.

Those skilled in the art should readily appreciate that the programs and methods for structuring audio data as defined herein are deliverable to a processing device in many forms, including but not limited to a) information permanently stored on non-writeable storage media such as ROM devices, b) information alterably stored on writeable storage media such as floppy disks, magnetic tapes, CDs, RAM devices, and other magnetic and optical media, or c) information conveyed to a computer through communication media, for example using baseband signaling or broadband signaling techniques, as in an electronic network such as the Internet or telephone modem lines. The disclosed method may be in the form of an encoded set of processor based instructions for performing the operations and methods discussed above. Such delivery may be in the form of a computer program product having a computer readable medium operable to store computer program logic embodied in computer program code encoded thereon, for example. The operations and methods may be implemented in a software executable object or as a set of instructions embedded in a carrier wave. Alternatively, the operations and methods disclosed herein may be embodied in whole or in part using hardware components, such as Application Specific Integrated Circuits (ASICs), Field Programmable Gate Arrays (FPGAs), state machines, controllers or other hardware components or devices, or a combination of hardware, software, and firmware components.

While the system and method for representing and processing audio information has been particularly shown and described with references to embodiments thereof, it will be understood by those skilled in the art that various changes in form and details may be made therein without departing from the scope of the invention encompassed by the appended claims.

What we claim is:

1. A computer-implemented method in which a computer system initiates execution of software instructions stored in memory, the computer-implemented method comprising:

identifying a score of audio information operable to be rendered by a rendering application, wherein identifying the score of audio information includes identifying audio files representing track elements of the score necessary for constructing a score having varying durations;

enumerating aspects of the score, the aspects operable to define renderable features of the score, the aspects further define a duration modifiable by the rendering application to a predetermined duration that preserves a tempo of the score, wherein enumerating aspects of the score comprises:

enumerating at least one field associated with each aspect of the score, fields indicative of rendering the score, each field defines properties of the score specific to a respective aspect, wherein enumerating at least one field associated with each aspect of the score comprises:

enumerating a location of the aspect in the score, the location defining an offset time relative to a reference point in the score, the offset time defining a cue point for inserting the aspect into the score;

enumerating a modifiable attribute associated with at least one aspect of the score, the modifiable attribute representing a qualitative value associated with the audio information that does not impact a duration of the score; and enumerating a sequential assignment of an aspect relative to at least one other aspect of the score, the sequential assignment describing an ordering of the parts and an ordering of clips within the parts;

enumerating a part aspect that identifies parts of the score, each of the parts defining a segment of the score operable as a rearrangeable element, the part aspect includes a subordinate part variation aspect that defines part variations; and enumerating a song aspect that identifies available song variations of the score, the song aspect including fields defining part aspects of the song variations and a default part variation used in rendering the audio information, the fields defining part aspects defining a minimum number of times and a maximum number of times that a respective part is playable in a particular song variation; and storing the aspects according to a predetermined syntax operable to indicate to the rendering application a manner of accessing each of the aspects of the score.

2. The computer-implemented method of claim 1 wherein enumerating at least one field associated with each aspect of the score comprises at least one of:

identifying a name associated with the part;

identifying a type associated with the part, the type indicative of a sequential ordering of the part; and identifying a part variation identifier associated with the part, the part variation identifier describing content of a part length variation.

3. The computer-implemented method of claim 1 wherein enumerating aspects of the score comprises:

enumerating an intensity aspect indicative of at least one intensity value for tracks of the score, each track operable to render audio content; and wherein enumerating at least one field associated with each aspect of the score comprises:

identifying at least one track associated with the at least one intensity value.

4. The computer-implemented method of claim 1 wherein enumerating aspects of the score comprises:

enumerating a modifier aspect indicative of at least one modifier value for a plurality of tracks operable to render audio content; and wherein enumerating at least one field associated with each aspect of the score comprises:

identifying a plurality of tracks associated with the at least one modifier value.

5. The computer-implemented method of claim 4 wherein enumerating a modifier aspect indicative of at least one modifier value for a plurality of tracks comprises at least one of:

enumerating a melody attribute indicative of a melody value for the plurality of tracks; and enumerating a harmony attribute indicative of a harmony value for the plurality of tracks.

6. The computer-implemented method of claim 1 wherein enumerating aspects of the score comprises:

enumerating a track aspect indicative of at least one track of the score operable to render audio content; and wherein enumerating at least one field associated with each aspect of the score comprises:

identifying at least one clip associated with the at least one track of the score; and identifying a location associated with the at least one clip, the location defining an offset time relative to a reference point in the score.

7. The computer-implemented method of claim 6 wherein identifying at least one clip associated with the at least one track of the score comprises:

specifying a file associated with each clip, a location of the file indicated by a uniform resource locator (URL).

8. The computer-implemented method of claim 1 wherein enumerating a modifiable attribute associated with at least one aspect of the score comprises:

identifying a preset value for each modifiable attribute, the preset value indicative of an initial value for each modifiable attribute.

9. The computer-implemented method of claim 1 comprising:

providing a manner of accessing by the rendering application via a graphical user interface, the rendering application responsive to the manner of accessing for determining the aspects of the score, the aspects of the score indicative of file locations and file formats.

10. The computer-implemented method of claim 1, wherein storing the enumerated aspects according to a predetermined syntax comprises:

storing the enumerated aspects of the score in a document object model according to a scripting language, the document object model indicating to the rendering application the manner of accessing each of the aspects of the score.

11. The computer-implemented method of claim 10 wherein storing the enumerated aspects according to a scripting language comprises:

storing the enumerated aspects according to an extensible markup language (XML) format.

12. A computerized device comprising:

a memory;

a processor;

a communications interface;

an interconnection mechanism coupling the memory, the processor and the communications interface; and wherein the memory is encoded with an audio formatting application that when executed on the processor provides an audio formatting process causing the computerized device to perform the operations of:

identifying a score of audio information operable to be rendered by a rendering application, wherein identifying the score of audio information includes identifying audio files representing track elements of the score necessary for constructing a score having varying durations;

enumerating aspects of the score, the aspects operable to define renderable features of the score, the aspects further define a duration modifiable by the rendering application to a predetermined duration that preserves a tempo of the score, wherein enumerating aspects of the score comprises:

enumerating at least one field associated with each aspect of the score, fields indicative of rendering the score, each field defines properties of the score specific to a respective aspect, wherein enumerating at least one field associated with each aspect of the score comprises:

enumerating a location of the aspect in the score, the location defining an offset time relative to a reference point in the score, the offset time defining a cue point for inserting the aspect into the score;

enumerating a modifiable attribute associated with at least one aspect of the score, the modifiable attribute representing a qualitative value associated with the audio information that does not impact a duration of the score; and enumerating a sequential assignment of an aspect relative to at least one other aspect of the score, the sequential assignment describing an ordering of the parts and an ordering of clips within the parts;

enumerating a part aspect that identifies parts of the score, each of the parts defining a segment of the score operable as a rearrangeable element, the part aspect includes a subordinate part variation aspect that defines part variations; and enumerating a song aspect that identifies available song variations of the score, the song aspect including fields defining part aspects of the song variations and a default part variation used in rendering the audio information, the fields defining part aspects defining a minimum number of times and a maximum number of times that a respective part is playable in a particular song variation; and storing the enumerated aspects according to a predetermined syntax operable to indicate to the rendering application a manner of accessing each of the aspects of the score.

13. The computerized device of claim 12 wherein enumerating at least one field associated with each aspect of the score comprises, via the processor, the audio formatting application identifying at least one of:

a name associated with the part;

a type associated with the part, the type indicative of a sequential ordering of the part; and a part variation identifier associated with the part, the part variation identifier describing content of a part length variation.

14. The computerized device of claim 12 wherein enumerating aspects of the score comprises, via the processor, the audio formatting application:

enumerating an intensity aspect indicative of at least one intensity value for tracks of the score, each track operable to render audio content; and wherein enumerating at least one field associated with each aspect of the score comprises, via the processor, the audio formatting application:

identifying at least one track associated with the at least one intensity value.

15. The computerized device of claim 12 wherein enumerating aspects of the score comprises, via the processor, the audio formatting application:

enumerating a modifier aspect indicative of at least one modifier value for a plurality of tracks operable to render audio content; and wherein enumerating at least one field associated with each aspect of the score comprises, via the processor, the audio formatting application:

identifying a plurality of tracks associated with the at least one modifier value.

16. The computerized device of claim 15 wherein enumerating a modifier aspect indicative of at least one modifier value for a plurality of tracks comprises, via the processor, the audio formatting application enumerating at least one of:

a melody attribute indicative of a melody value for the plurality of tracks; and a harmony attribute indicative of a harmony value for the plurality of tracks.

17. The computerized device of claim 12 wherein enumerating aspects of the score comprises, via the processor, the audio formatting application:

enumerating a track aspect indicative of at least one track operable to render audio content; and wherein enumerating at least one field associated with each aspect of the score comprises, via the processor, the audio formatting application:

identifying at least one clip associated with the at least one track of the score; and identifying a location associated with the at least one clip, the location defining an offset time relative to a reference point in the score.

18. The computerized device of claim 12 further comprising:

providing a manner of accessing by the rendering application via a graphical user interface, the rendering application responsive to the manner of accessing for determining the aspects of the score, the aspects of the score indicative of file locations and file formats.

19. A computer program product having a computer-storage medium operable to store computer program logic embodied in computer program code encoded thereon as an encoded set of processor based instructions that perform audio formatting comprising:

computer program code for identifying a score of audio information operable to be rendered by a rendering application, wherein identifying the score of audio information includes identifying audio files representing track elements of the score necessary for constructing a score having varying durations;

computer program code for enumerating aspects of the score, the aspects operable to define renderable features of the score, the aspects further define a duration modifiable by the rendering application to a predetermined duration that preserves a tempo of the score, wherein computer program code for enumerating aspects of the score comprises:

computer program code for enumerating at least one field associated with each aspect of the score, fields indicative of rendering the score, each field defines properties of the score specific to a respective aspect, wherein computer program code for enumerating at least one field associated with each aspect of the score comprises:

computer program code for enumerating a location of the aspect in the score, the location defining an offset time relative to a reference point in the score, the offset time defining a cue point for inserting the aspect into the score;

computer program code for enumerating a modifiable attribute associated with at least one aspect of the score, the modifiable attribute representing a qualitative value associated with the audio information that does not impact a duration of the score; and computer program code for enumerating a sequential assignment of an aspect relative to at least one other aspect of the score, the sequential assignment describing an ordering of the parts and an ordering of clips within the parts;

computer program code for enumerating a part aspect that identifies parts of the score, each of the parts defining a segment of the score operable as a rearrangeable element, the part aspect includes a subordinate part variation aspect that defines part variations; and computer program code for enumerating a song aspect that identifies available song variations of the score, the song aspect including fields defining part aspects of the sons variations and a default part variation used in rendering the audio information, the fields defining part aspects defining a minimum number of times and a maximum number of times that a respective part is playable in a particular song variation; and computer program code for storing the enumerated aspects according to a scripting language operable to indicate to the rendering application a manner of accessing each of the aspects of the score.

20. The computer program product of claim 19 wherein the computer program code for storing the enumerated aspects according to a scripting language comprises:

computer program code for storing the enumerated aspects according to an extensible markup language (XML) format.

21. The computer-implemented method of claim 1, wherein enumerating at least one field associated with each aspect of the score comprises at least one of:

identifying a name associated with a given part;

identifying a type associated with the given part, the type indicative of a sequential ordering of the given part; and identifying a part variation identifier associated with the given part, the part variation identifier describing content of a part length variation, the part having multiple variations of a same content, the multiple variations having varying durations corresponding to a number of clips associated with a respective part variation, the part variation including at least one subordinate clip aspect having fields defining a position in samples of a clip, a number of bars of the clip, a number of beats of the clip, and a metric unit of the clip.

22. The computer-implemented method of claim 1, wherein enumerating aspects of the score comprises:

enumerating an intensity aspect indicative of at least one intensity value for tracks of the score, each track operable to render audio content, the intensity aspect defining tracks assigned to a specific intensity value of a respective intensity aspect, the intensity aspect includes subordinate track aspects representing tracks assigned to a particular intensity group, the subordinate track aspects defining an identity of a given track and individual volume of the given track; and wherein enumerating at least one field associated with each aspect of the score comprises:

identifying at least one track associated with the intensity value of a respective intensity aspect.

23. The computer-implemented method of claim 1, wherein enumerating aspects of the score includes:

enumerating a beat aspect, the beat aspect includes fields that define time measurements including a beat nominator, a beat denominator, and beats per minute.

24. The computer-implemented method of claim 1, wherein enumerating at least one field associated with each aspect of the score comprises at least one of:

identifying a name associated with a given part;

identifying a type associated with the given part, the type indicative of a sequential ordering of the given part; and identifying a part variation identifier associated with the given part, the part variation identifier describing a content of a part length variation, the given part having multiple variations containing a same content that have varying durations corresponding to a number of clips associated with a respective part variation, the part variation including at least one subordinate clip aspect having fields defining a position in samples of a clip, a number of bars of the clip, a number of beats of the clip, and a metric unit of the clip.

25. The computer-implemented method of claim 1, wherein enumerating aspects of the score comprises:

enumerating a song aspect that identifies available variations of the score, the song aspect includes fields defining part aspects of song variations and a default part variation used in rendering the audio information, the song aspect fields defining a minimum number of times and a maximum number of times that a respective part is playable in a particular song variation.

26. The computer-implemented method as in claim 10, wherein enumerating the aspects of the score includes storing tags in the document object model, the tags specifying the aspects of the score for rendering by the rendering application in an editor graphical user interface on a display screen.

* * * * *

UNITED STATES PATENT AND TRADEMARK OFFICE

CERTIFICATE OF CORRECTION

PATENT NO. : 7,612,279 B1
APPLICATION NO. : 11/585328
DATED : November 3, 2009
INVENTOR(S) : Schnepel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 63 days.

Signed and Sealed this

Nineteenth Day of October, 2010

David J. Kappos

David J. Kappos
*Director of the United States Patent and Trademark Office*